United States Patent [19]

Barham

[11] Patent Number: 5,064,024

[45] Date of Patent: Nov. 12, 1991

[54] LADDER LEG EXTENDER APPARATUS WITH IMPROVED VERTICAL ADJUSTMENT MEANS

[76] Inventor: Leonard J. Barham, 4824 Mount Vernon Church Rd., Burlington, N.C. 27217

[21] Appl. No.: 674,615

[22] Filed: Mar. 25, 1991

[51] Int. Cl.[5] ..... E06C 7/44

[52] U.S. Cl. ..... 182/201; 182/111

[58] Field of Search ..... 182/201, 202, 203, 204, 182/205, 111

[56] References Cited

U.S. PATENT DOCUMENTS

| | | | |
|---|---|---|---|
| 1,290,690 | 1/1919 | Watson | 182/201 |
| 2,405,269 | 8/1946 | Prutsman | 228/63 |
| 2,414,082 | 12/1968 | Gilland | 182/204 |
| 3,933,222 | 1/1976 | Craig, Jr. | 182/204 |
| 4,209,078 | 6/1980 | Gerber | 182/203 |
| 4,284,172 | 8/1981 | Cohen | 182/204 |
| 4,606,432 | 8/1986 | Belt | 182/204 |
| 4,607,726 | 8/1986 | Davis et al. | 182/204 |
| 4,766,976 | 8/1988 | Wallick, Jr. | 182/201 |
| 4,807,720 | 2/1989 | Kim | 182/205 |
| 4,844,208 | 7/1989 | Veness | 182/201 |

FOREIGN PATENT DOCUMENTS

| | | | |
|---|---|---|---|
| 112531 | 2/1941 | Australia | 182/204 |
| 132455 | 5/1949 | Australia | 182/204 |
| 219043 | 10/1958 | Australia | 182/204 |
| 247983 | 11/1963 | Australia | 182/204 |

*Primary Examiner*—Reinaldo P. Machado
*Attorney, Agent, or Firm*—Richard E. Jenkins

[57] ABSTRACT

A ladder leg extender apparatus for attachment to the leg of a ladder to lengthen the leg as required to support the ladder on an uneven support surface. The apparatus comprises a sleeve secured to a shortened leg of the ladder which slidably carries an extendible support leg therein for movement inwardly and outwardly of the sleeve to adjust the length of the leg. Infinitely variable vertical adjustment of the support leg is achieved by (1) loosening two turn bolts which secure the support leg between the bolts on one side and a coarse file on the other side thereof within the sleeve and then (2) tightening the bolts when the support leg is properly slidably adjusted with the associated ladder is in an upright and level orientation.

8 Claims, 4 Drawing Sheets

LADDER LEG EXTENDER APPARATUS WITH IMPROVED VERTICAL ADJUSTMENT MEANS

TECHNICAL FIELD

The present invention relates to ladder leg extenders, and more particularly to a ladder leg extender which enables a ladder to be positioned upright on an inclined or irregular support surface.

RELATED ART

The field of the ladder leveling device art is voluminous with ladder leveler attachments which are intended for use to enable a ladder to be positioned upright on an inclined or irregular support surface. Some of the ladder leveling attachments are intended for use on one ladder leg whereas other attachments are intended to be provided on both legs of the ladder. Both types serve to increase the length of one leg relative to the other leg so as to compensate for an uneven support surface upon which the ladder is to be positioned. These prior art devices are exemplified by leveling devices shown in U.S. Pat. Nos. 2,405,269; 3,414,082; 3,933,222; 4,209,078; 4,284,172; 4,606,432; 4,607,726; 4,766,976; 4,807,720; and 4,844,208.

Unfortunately, applicant does not believe that any of the prior art devices are entirely satisfactory for their intended use since they are either unduly complex and expensive to manufacture, time consuming and difficult to utilize to level a ladder, and/or do not provide a high-strength or rugged securement of the extendible leg at the desired adjusted position. As a result of the shortcomings of the prior art ladder leveling attachments, as represented by the references cited above, there has developed a substantial need for improvement in this type of ladder leveling attachment.

It is very important that a ladder leveling attachment be quick and easy to adjust, provide for an infinitely variable vertical adjustment, and be very rugged in so far as the releasable engagement of the adjusted extendible leg. The latter feature is particularly important to ensure the safety of the individual supported by the ladder since any slippage of the extendible leg would serve to put the individual at risk of serious bodily harm.

DISCLOSURE OF THE INVENTION

In accordance with the present invention, applicant provides a ladder leg extender apparatus with improved vertical adjustment means. The ladder leg extender apparatus is adapted to be secured to the lower portion of a ladder leg so that the ladder may be leveled for use on an inclined or irregular support surface and comprises an elongate sleeve having mounting means for securing the sleeve to the lower portion of a ladder leg. An elongate support leg having a length greater than the elongate sleeve is slidably carried by the sleeve, and the lower end of the support leg is slidably extendible beyond the lower end of the sleeve and further includes a pivotably mounted support foot thereon. The ladder leg extender apparatus further comprises vertical adjustment means providing for slidable adjustment of the support leg to a desired extended position relative to the sleeve and securement thereof at the extended position.

The vertical adjustment means comprises at least one rotatable bolt threadingly received within an aperture defined by one side of the elongate sleeve so that the bolt face is adjacent to one side of the elongate support leg and may be rotated into contact and away from contact therewith, and an elongate file element positioned adjacent to the opposing side of the elongate sleeve so that the ridged cutting surface thereof is adjacent to the opposing side of the elongate support leg. Thus, the support leg may be slidably adjusted by loosening the rotatable bolt, and the support leg may be secured at a desired extended position by tightening the rotatable bolt so as to immovably secure the support leg between the rotatable bolt and the file element which are located on opposing sides of the elongate sleeve.

It is therefore the object of this invention to provide a ladder leg extender apparatus which is unusually quick and easy to adjust and use.

Another object of this invention is to provide a ladder leg extender apparatus which is infinitely vertically adjustable.

A further object of this invention is to provide a ladder leg extender apparatus which provides a strong and rugged engagement of the adjusted extendible support leg so as to be very safe and reliable in use.

Some of the objects of the invention having been stated, other objects will become evident as the description proceeds, when taken in connection with the accompanying drawings described hereinbelow.

BRIEF DESCRIPTION OF THE DRAWINGS

In the accompanying drawings, in which is shown one of the various possible illustrative embodiments of this invention, wherein like reference characters identify the same or like parts.

BEST MODE FOR CARRYING OUT THE INVENTION

Figure 1:
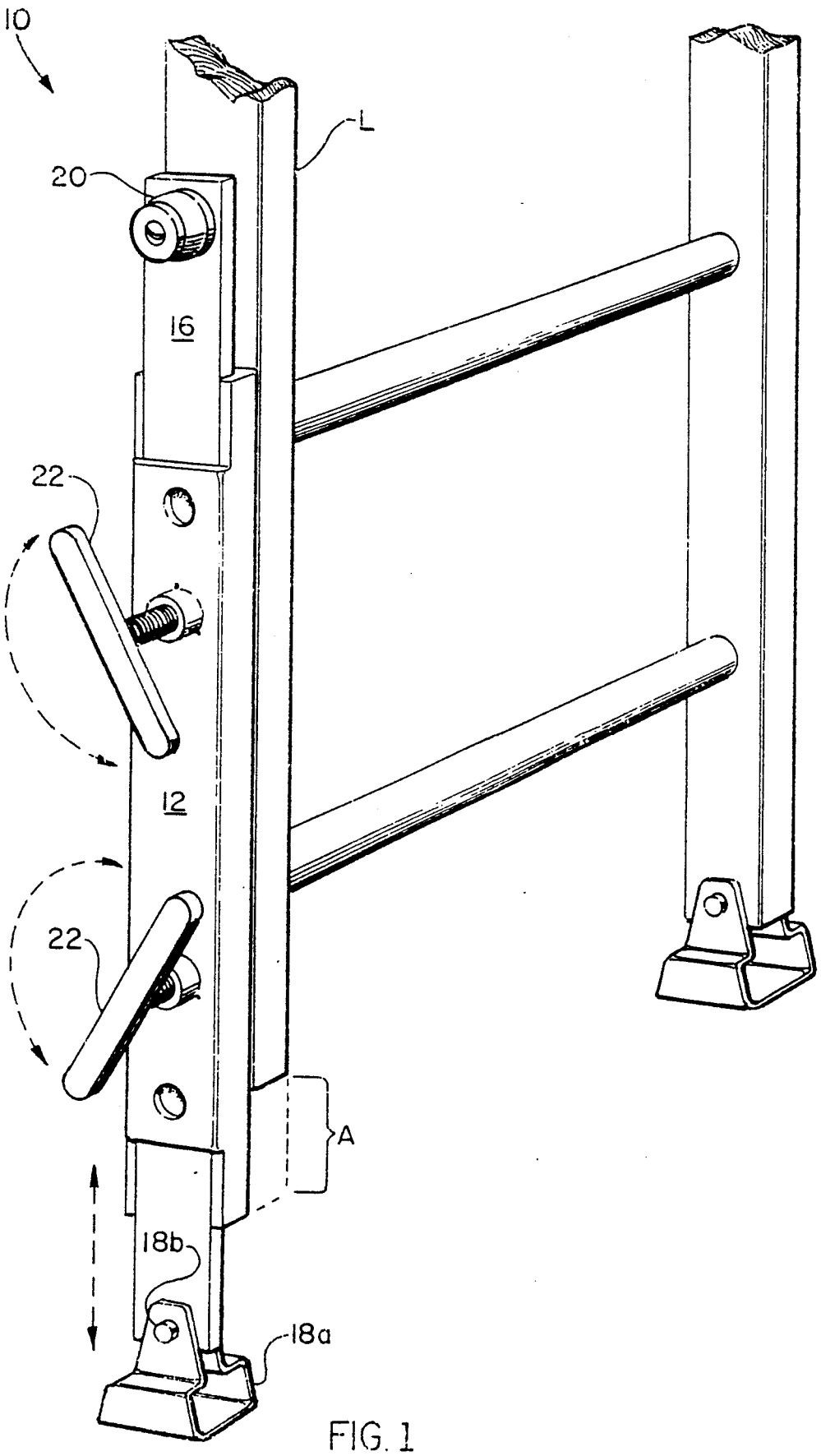
FIG. 1 is a perspective view showing a ladder equipped with the ladder leg extender apparatus of the present invention.
Figure 2:
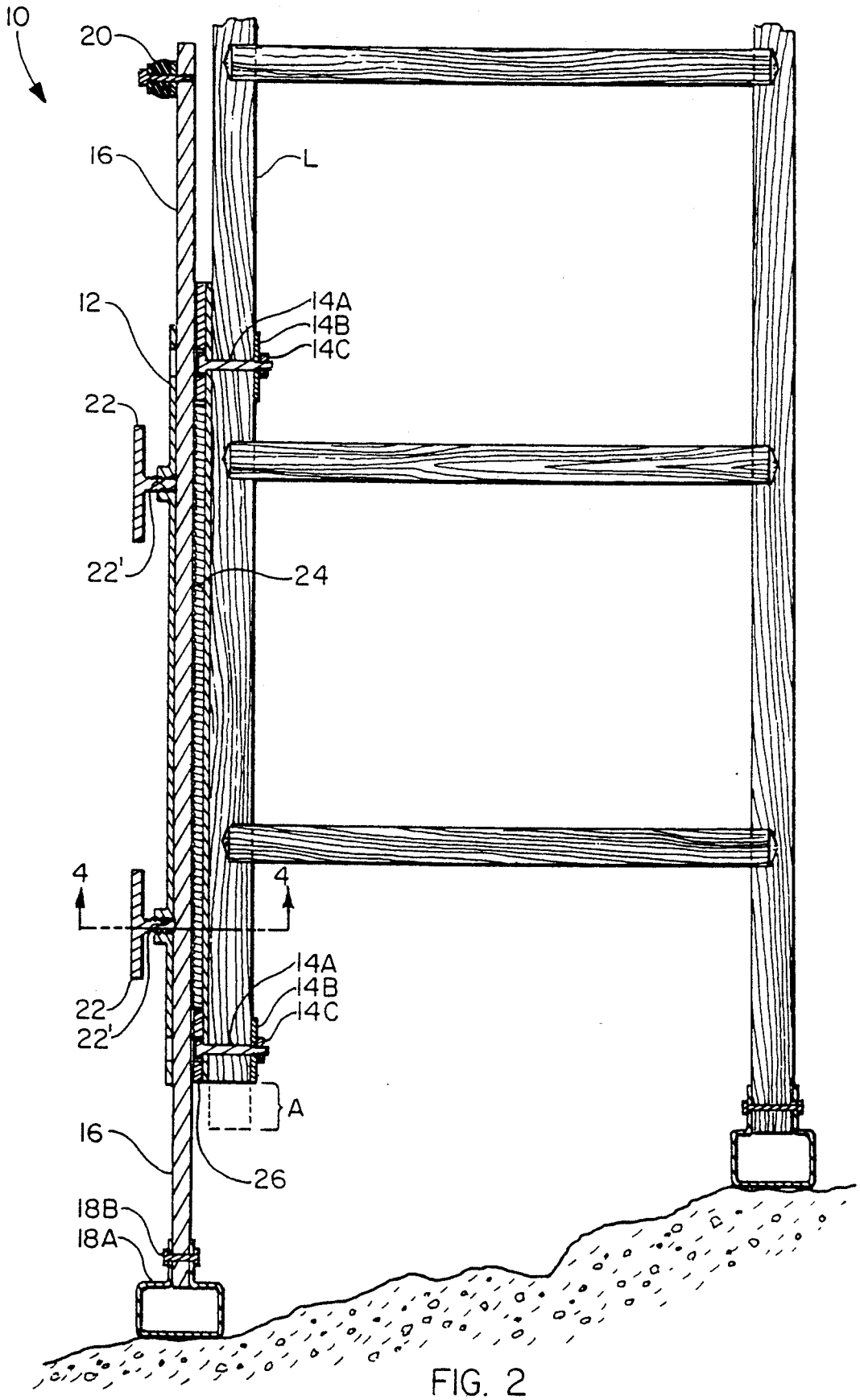
FIG. 2 is a vertical cross-sectional view of a ladder with the ladder leg extender apparatus of the present invention attached thereto.

With reference now to the drawings, the ladder leg extender apparatus of the invention is indicated generally by reference character 10, and in FIGS. 1 and 2 is shown attached to one leg of a ladder L from which a portion A (about 4–8 inches of the terminal length) has been cut off. Although the preferred embodiment of the invention contemplates removal of at least several inches of one foot of a wooden ladder prior to securement thereto, ladder leg extender apparatus 10 may also be used in circumstances where portion A of one leg of a ladder is not removed and/or in combination with metal ladders such as those constructed of aluminum or the like.

Apparatus 10 comprises an elongate sleeve 12 which is secured to a leg of ladder L at each end thereof by bolts 14A and associated washers 14B and nuts 14C in a conventional manner. An elongate support leg 16 is slidably carried by sleeve 12 and is significantly greater in length than sleeve 12 so as to adjustably extend from the bottom thereof a desired distance to level the ladder on an uneven support surface. Extendible support leg 16 has a foot 18A pivotally mounted with pin 18B to the lower end thereof and a bumper or stop 20 mounted at the upper end thereof to prevent support leg 16 from sliding out of sleeve 12 during adjustment.

Figure 3:
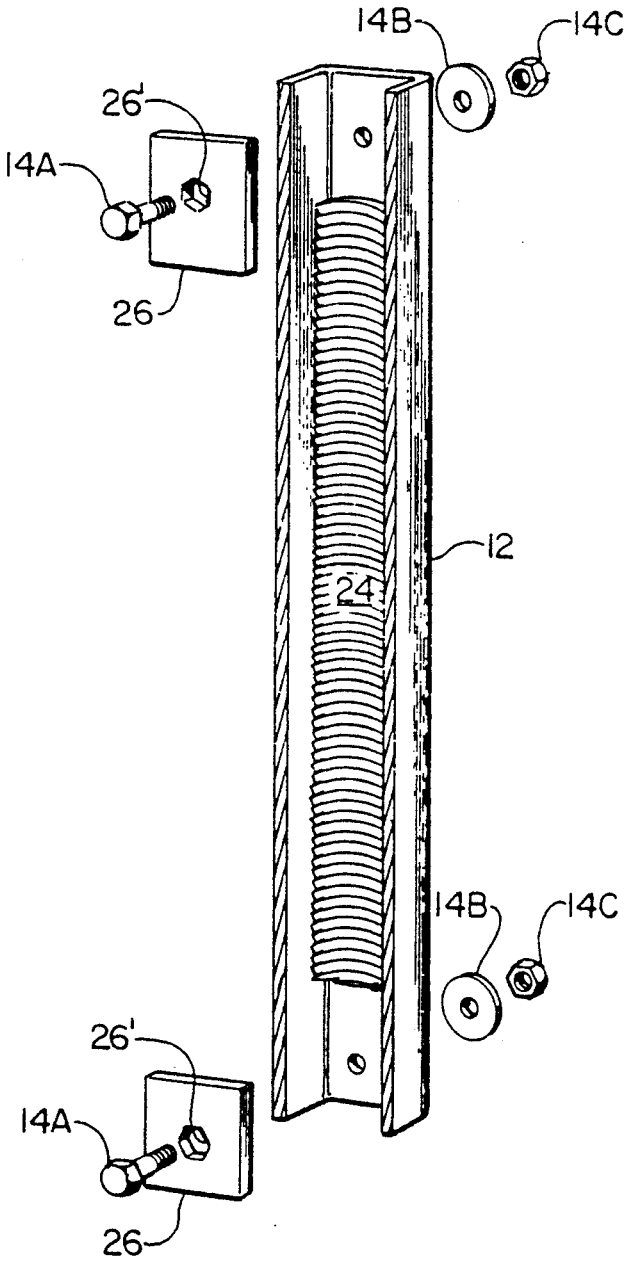
FIG. 3 is a perspective view of the sleeve of the ladder leg extender apparatus of the present invention with the front portion removed for clarity of viewing the file and retention plates therefor contained within the sleeve.
Figure 4:
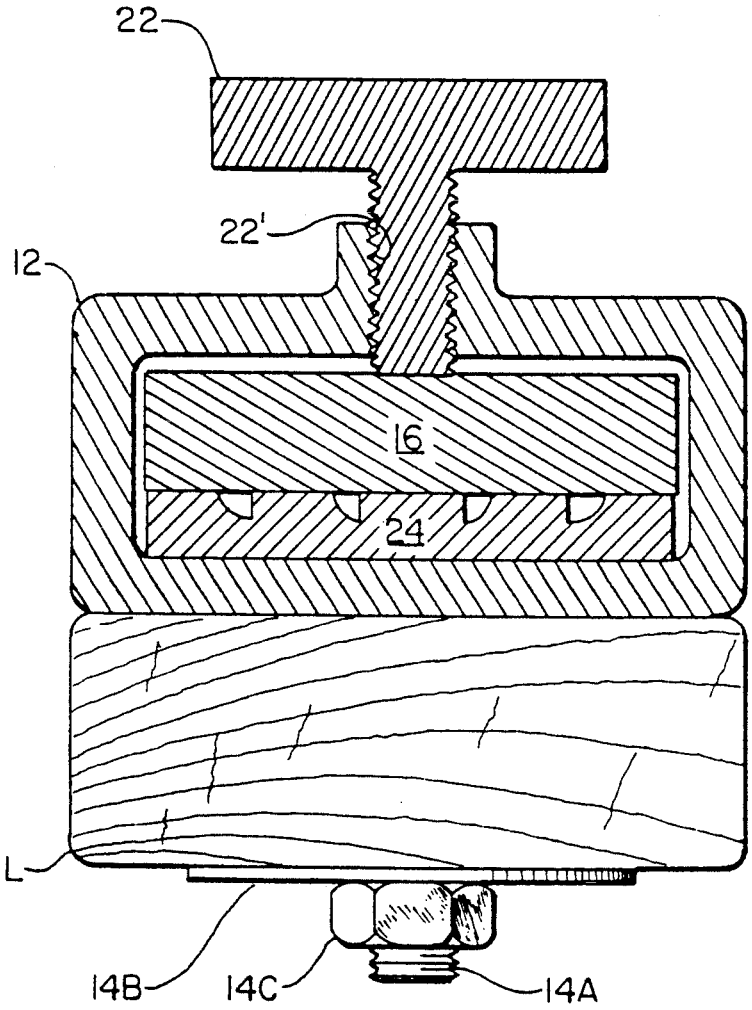
FIG. 4 is a horizontal cross-sectional view of the ladder leg extender apparatus of the present invention taken along line 4—4 in FIG. 2.

As best seen with reference to FIGS. 2 and 4, extendible support leg 16 is snugly but slidably positioned within sleeve 12. Two spaced-apart turn bolts 22 (bolts having a suitable leverage imparting handle element) are threadingly received within apertures 22' within the outside wall of sleeve 12. A coarse file 24 (such as an automotive body shop file Item Number 77347 manufactured by Keysco Tool Division of S&H Industries located in Cleveland, Ohio) is positioned between the back wall of sleeve 12 and support leg 16 with the ridged cutting surface thereof adjacent to support leg 16. In order to retain file 24 in its relative position within sleeve 12, retention plates 26 are provided at each end thereof within sleeve 12 (see FIG. 3). In the preferred embodiment of applicant's invention, retention plates 26 each define an aperture therein for fixedly receiving the heads of bolt 14A used to secure ladder leg extender apparatus 10 to ladder L. In this fashion, the heads of bolts 14A are maintained flush with the associated retention plates 26 so as not to obstruct the slidable passage of extendible support leg 16 thereover.

In use, ladder L is positioned at a desired location adjacent to a house or the like wherein the support surface is uneven. To position ladder L in an upright and even orientation, turn bolts 22 of ladder leg extender apparatus 10 are quickly turned counter-clockwise so as to rotate the bolt faces out of contact with support leg 16 slidably carried within sleeve 12. Support leg 16 is then allowed to freely drop downwardly until pivotable support foot 18A properly seats on the uneven support surface. Next, turn bolts 22 are quickly turned clockwise in order to bring the respective bolt faces into contact with support leg 16 and urge it into contact with the ridged cutting surface of file 24. Thus, support leg 16 is immovably and very securely engaged between turn bolts 22 and file 24 so as to ensure the safety of the user while supported by ladder L.

The sleeve 12 and support leg 16 of ladder leg extender apparatus 10 may be made of any suitable material and may be provided in substantially any desired size. Applicant's preferred embodiment illustrated herein provides for sleeve 12 to be fabricated of steel and support leg 16 to be fabricated from lightweight aluminum in order to facilitate quick and easy extensible adjustment of support leg 16. A representative ladder leg extender apparatus in accordance with the invention has an overall sleeve 12 length of about 20 inches, a support leg 16 length of about 30 inches, and a file 24 length of about 14 inches, although other sizes are clearly within the scope of the invention.

It will be understood that various details of the invention may be changed without departing from the scope of the invention. Furthermore, the foregoing description is for the purpose of illustration only, and not for the purpose of limitation—the invention being defined by the claims.

What is claimed is:

1. A vertically adjustable ladder leg extender apparatus adapted to be secured to the lower portion of the ladder leg so that the ladder may be leveled and used on an inclined support surface, comprising:

an elongate sleeve having mounting means for securing said sleeve to the lower portion of the ladder leg;

an elongate support leg having a length greater than said elongate sleeve and being slidably carried thereby, the lower end of said support leg being slidably extendible beyond the lower end of said sleeve and having a pivotably mounted support foot thereon for engaging a surface on which the ladder is positioned; and vertical adjustment means providing for slidable adjustment of said support leg to a desired extended position relative to said sleeve and securement at the extended position, said adjustment means comprising at least one rotatable bolt threadingly received within an aperture defined by one side of said elongate sleeve so that the bolt face is adjacent one side of said elongate support leg and may be rotated into contact and away from contact therewith, and an elongate file element positioned within said elongate sleeve adjacent the opposing side thereof so that the ridged cutting surface of the file element is adjacent the opposing side of said elongate support leg;

whereby said support leg may be slidably adjusted by loosening the rotatable bolt and said support leg may then be secured at a desired extended position by tightening the rotatable bolt so as to immovably engage said support leg between the rotatable bolt and the file element.

2. A vertically adjustable ladder leg extender apparatus according to claim 1 wherein the upper end of said elongate support leg includes an outwardly protruding stop element mounted thereto to prevent the upper end of said support leg from sliding through said sleeve.

3. A vertically adjustable ladder leg extender apparatus according to claim 1 wherein said vertical adjustment means comprises two spaced-apart rotatable bolts wherein each bolt is provided with a turn handle at the end opposite the bolt face.

4. A vertically adjustable ladder leg extender apparatus adapted to be secured to the lower portion of the ladder leg so that the ladder may be leveled and used on an inclined support surface, comprising:

an elongate sleeve having mounting means for securing said sleeve to the lower portion of the ladder leg;

an elongate support leg having a length greater than said elongate sleeve and being slidably carried thereby, wherein the upper end of said elongate support leg includes an outwardly protruding stop element mounted thereto to prevent the upper end of said support leg from sliding through said sleeve and the lower end of said support leg is slidably extendible beyond the lower end of said sleeve and includes a pivotably mounted support foot for engaging a surface on which the ladder is positioned; and vertical adjustment means providing for slidable adjustment of said support leg to a desired extended position relative to said sleeve and securement at the extended position, said adjustment means comprising two spaced-apart rotatable bolts wherein each bolt is provided with a turn handle and is threadingly received within a respective aperture defined by one side of said elongate sleeve so that the bolt faces are adjacent one side of said elongate support leg and may be rotated into contact and away from contact therewith, and an elongate file element positioned within said elongate sleeve adjacent the opposing side thereof so that the ridged cutting surface of the file element is adjacent the opposing side of said elongate support leg;

whereby said support leg may be slidably adjusted by loosening the rotatable bolts and said support leg may then be secured at a desired extended position by tightening the rotatable bolts so as to immovably engage said support leg between the rotatable bolts and the file element.

5. In a vertically adjustable ladder leg extender apparatus of the type adapted to be secured to the lower portion of the ladder leg so that the ladder may be leveled and used on an inclined support surface and comprising an elongate sleeve having mounting means for securing said sleeve to the lower portion of the ladder leg, an elongate support leg slidably carried thereby wherein the lower end of said support leg is slidably extendible beyond the lower end of said sleeve and includes a pivotably mounted support foot thereon for engaging a surface on which the ladder is positioned, the improvement comprising:

vertical adjustment means providing for slidable adjustment of said support leg to a desired extended position relative to said sleeve and securement at the extended position, said adjustment means comprising at least one rotatable bolt wherein the bolt is provided with a turn handle and is threadingly received within an aperture defined by one side of said elongate sleeve so that the bolt face is adjacent one side of said elongate support leg and may be rotated into contact and away from contact therewith, and an elongate file element positioned within said elongate sleeve adjacent the opposing side thereof so that the ridged cutting surface of the file element is adjacent the opposing side of said elongate support leg;

whereby said support leg may be slidably adjusted by loosening the rotatable bolt and said support leg may then be secured at a desired extended position by tightening the rotatable bolt so as to immovably engage said support leg between the rotatable bolt and the file element.

6. A vertically adjustable ladder leg extender apparatus according to claim 5 wherein the upper end of said elongate support leg includes an outwardly protruding stop element mounted thereto to prevent the upper end of said support leg from sliding through said sleeve.

7. A vertically adjustable ladder leg extender apparatus according to claim 5 wherein said vertical adjustment means comprises two spaced-apart rotatable bolts.

8. A vertically adjustable ladder leg extender apparatus according to claim 5 wherein the file element is about 14 inches in length.

* * * * *